United States Patent [19]

Takahashi et al.

[11] Patent Number: 4,501,419

[45] Date of Patent: Feb. 26, 1985

[54] COLLATOR HAVING A TRANSFER CAPABILITY

[75] Inventors: Yuji Takahashi, Tokyo; Hisaji Masaki, Kawasaki; Muneo Adachi; Masaru Igarashi, both of Yokohama, all of Japan

[73] Assignee: Canon Kabushiki Kaisha, Tokyo, Japan

[21] Appl. No.: 294,573

[22] Filed: Aug. 20, 1981

[30] Foreign Application Priority Data

Aug. 28, 1980 [JP] Japan ..... 55-118614
Aug. 28, 1980 [JP] Japan ..... 55-118615
Aug. 28, 1980 [JP] Japan ..... 55-118616

[51] Int. Cl.[3] ..... B65H 31/24; B65H 39/11
[52] U.S. Cl. ..... 271/288; 271/297
[58] Field of Search ..... 271/258, 259, 287, 288, 271/289, 290, 296, 297, 298, 305

[56] References Cited

U.S. PATENT DOCUMENTS

| | | | |
|---|---|---|---|
| 2,124,858 | 7/1938 | Marchand | 271/279 X |
| 2,487,347 | 11/1949 | Malmros et al. | 271/279 |
| 2,938,721 | 5/1960 | Buckingham et al. | 271/265 X |
| 3,697,063 | 10/1912 | Greenfield et al. | 271/4 |
| 3,709,485 | 1/1973 | Acquaviva | 271/297 X |
| 3,871,643 | 3/1975 | Kukucka et al. | 271/290 |
| 3,905,594 | 9/1975 | Davis | 271/296 |
| 3,944,207 | 3/1976 | Bains | 271/297 X |
| 3,953,023 | 4/1976 | Cross et al. | 271/296 |
| 4,134,581 | 1/1979 | Johnson et al. | 271/288 |
| 4,200,386 | 4/1980 | Queener | 271/287 |
| 4,256,297 | 3/1981 | Prieur et al. | 271/305 X |
| 4,318,542 | 3/1982 | Altmann et al. | 271/297 X |
| 4,361,320 | 11/1982 | Kikuchi et al. | 271/288 |

*Primary Examiner*—Robert B. Reeves
*Assistant Examiner*—David F. Hubbuch
*Attorney, Agent, or Firm*—Fitzpatrick, Cella, Harper & Scinto

[57] ABSTRACT

There is disclosed a collator which can access a desired one of a plurality of recording medium bins at any timing and which allows a maximum utilization of the plurality of bins. The collator includes a transporter for transferring recording medium to bins, a deflector for guiding the recording medium to the selected bin, an empty detector for detecting an empty state of the recording medium in the bins, and a controller for controlling the operation of the deflector such that when a predetermined amount of recording media have been stored in the bin during the recording medium storage operation, the recording media are transferred to other storage, and when said empty detector detects that the recording media have been removed from the bin having the predetermined amount of recording media stored therein, the transport of the recording media to the emptied bin is permitted.

20 Claims, 17 Drawing Figures

| FIG. 15A |
| --- |
| FIG. 15B |

COLLATOR HAVING A TRANSFER CAPABILITY

BACKGROUND OF THE INVENTION

1. Field of the Invention

The present invention relates to a collator for accommodating record media ejected from a laser beam printer, a copying machine or the like, and more particularly to a collator which can select any storage pocket.

2. Description of the Prior Art

In a prior art laser beam printer or high speed copying machine, a stacker is used to stack record media (hereinafter referred to as transfer papers) to accommodate the ejected transfer papers. Such a stacker is simple in structure, is inexpensive and allows a large volume of stack, but in order to sort the stack, papers having special marks printed thereon must be placed between the papers to allow the alternation of the manner of stacking. When a plurality of sets of copies of the same text are to be prepared, the collation is difficult to attain. In order to avoid the collation, output to the laser beam printer may be repetitively applied from the beginning to the end by the number of times equal to the desired number of sets of copies. However, it takes a long waiting time and leads to a reduction of throughput (the number of copies produced in a given time period) of the high speed terminal such as the laser beam printer.

In a sorter usually used in the copying machine, copies can be produced within a limit of a maximum number of copies which can be stacked in one bin and within a limit of the number of bins in the sorter. For example, when five sets of copies are to be produced with a 20-bin sorter, five bins are used and the remaining fifteen bins are not used. If a capacity of each bin is 50 copies, copies can be produced for a set of up to 50 pages. However, in the high speed machine such as laser beam printer or high speed copying machine, the bins are filled in a short time and an operator has to frequently take out the copies. This is troublesome to the operator. Furthermore, in the copying machine, when a page of the text is to be changed to a next page, the text page must be exchanged. Accordingly, it cannot occur that a first copy for the next text page is produced immediately after the last copy of the current text page. Therefore, it is possible for a switching mechanism of the sorter bins to select a first bin during that period to allow the accommodation of the copies in the first bin. In the laser beam printer, however, since it is possible to output page information serially, when five sets of copies, for example, are to be produced, a first copy for the page eleven is produced immediately after the production of the fifth copy for the page ten so that the first copy for the page eleven must be accommodated in the first bin before the fifth copy for the page ten enters the fifth bin. In a conventional sorter, in order to prevent such a phenomenon from occurring, the copying operation for the next page is suppressed until all of the copies for the currently copied page have been accommodated in the bin. Thus, because of such nature of the sorter, the waiting time of the laser beam printer, which allows the sequential output in nature, increases which leads to substantial reduction of the throughput.

SUMMARY OF THE INVENTION

It is an object of the present invention to provide a collator which can access a desired one of a plurality of transfer medium storage bins at any timing and which allows a maximum utilization of the plurality of storage bins.

It is another object of the present invention to provide a collator which allows an access to a full storage bin after the transfer papers have been removed from the full storage bin during the storage operation of the transfer papers.

It is a further object of the present invention to provide a collator having priority in removing the transfer papers from the full storage bins.

It is a still further object of the present invention to provide a collator in which a time required to transport the transfer papers to a desired storage bin is previously calculated and the transfer papers are directed to the desired storage bins based on the calculated transport time so that the transfer papers are transported at such a rate that allows a next transfer paper to reach a storage bin of next to the farthest stage before a transfer paper enters a storage bin of the farthest stage.

The above and other objects of the present invention will become more apparent from the following description.

BRIEF DESCRIPTION OF THE DRAWINGS

FIGS. 4-1 and 4-2 show block diagrams of a control unit of the sorter,

DETAILED DESCRIPTION OF THE PREFERRED EMBODIMENTS

The preferred embodiments of the present invention will now be explained in detail with reference to the accompanying drawings.

Figure 1:
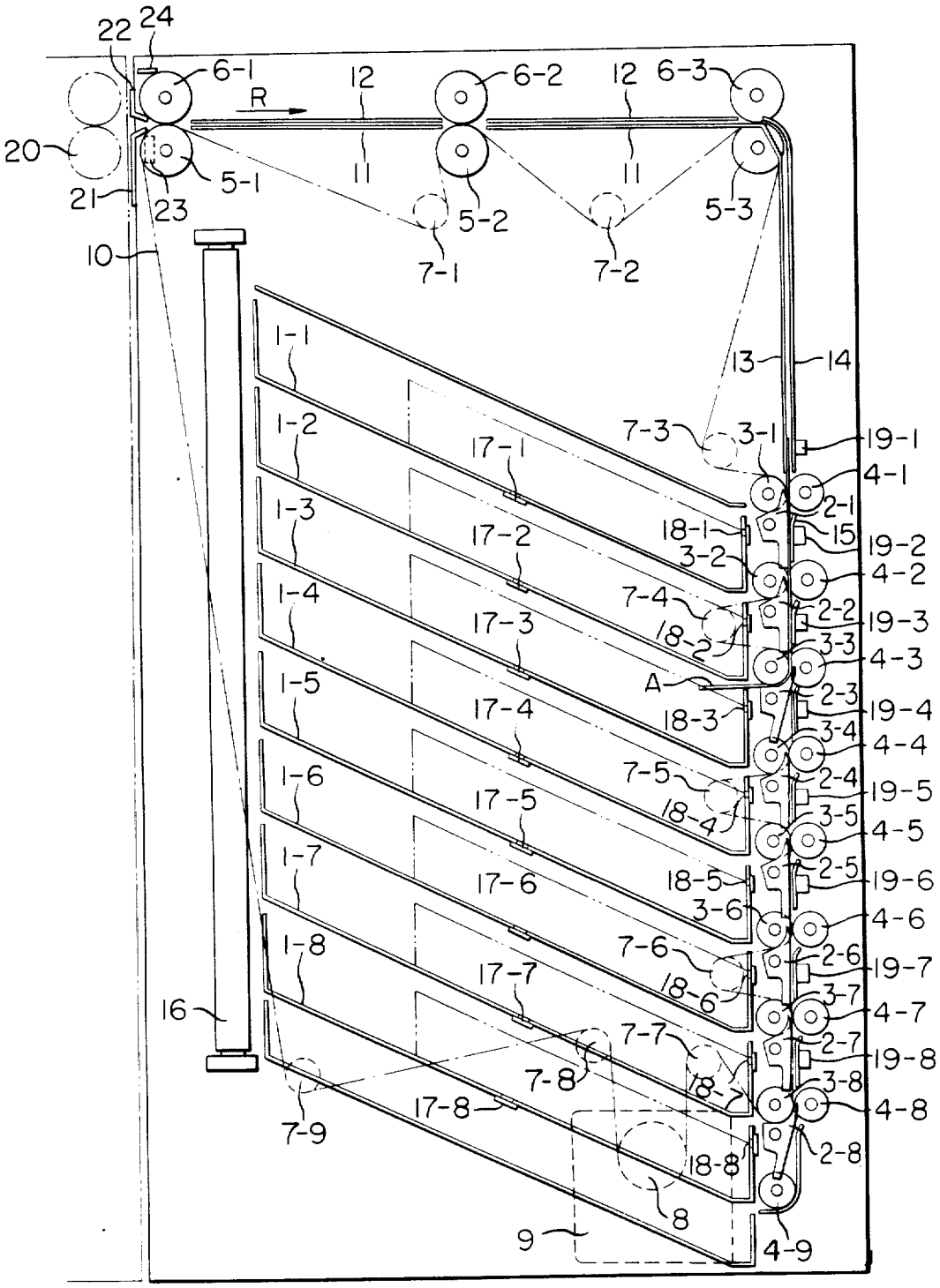
FIG. 1 shows a sectional view of a sorter.

FIG. 1 shows a sectional view of a sorter. A transfer paper A ejected from a printer paper ejection roller 20 is guided to sorter inlet guides 21 and 22 and transported in the direction of an arrow R while it is pinched by a horizontal roller 5-1 and a horizontal pressure roller 6-1. A lamp 23 and a photo-sensitive element 24 serving as a sensor to detect a leading edge of the transfer paper are arranged at an inlet area of the sorter. The transfer paper fed by the horizontal roller 5-1 passes through a space between a horizontal lower guide 11 and a horizontal upper guide 12, passes past horizontal rollers 5-2 and 5-3 and horizontal pressure rollers 6-2 and 6-3 and guided to a vertical left guide 13 and a vertical right guide 14. The transfer paper fed vertically passes through spaces between vertical feed rollers 3-1-8 and followers 4-1-8 and fed to bins 1-1-8. The vertical feed rollers 3-1-8 and the horizontal rollers 5-1-3 are rotated at a constant velocity by a drive pulley 8 mounted on a member 9, through a belt 10, which is tensioned by idler pulleys 7-1-9 to convey a necessary drive force to the rollers. Switching pawls 2-1-8 for guiding the transfer papers to the respective bins 1-1-8 are arranged in the vertical transport path, one for each of the bins. The switching pawls are actuated by solenoids to be described later. Reflection type sensors 19-1-8, which serve to check the presence or absence of a jam in the vertical transport path and to check if the transfer papers have been transported to specified bins, are arranged on the vertical right guide and the vertical left guide. Empty detection sensors 17-1-8 are mounted at the bottoms of the bins 1-1-8 and fill detection sensors 18-1-8 are mounted at the stack reference ends of the bins 1-1-8. The insides of the bins are illuminated by a light from a fluorescent lamp 16 to allow the visual check of the presence or absence of the transfer papers and the stack condition.

Figure 2:
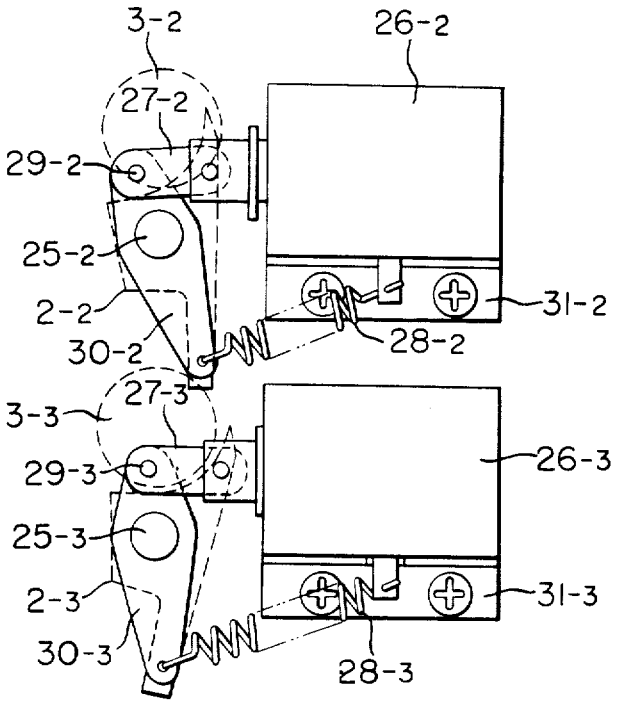
FIG. 2 illustrates a relation between a solenoid and a switching pawl.

FIG. 2 shows a relation between the switching pawls of the sorter and the solenoids. For the sake of convenience, only those for the second and third bins are shown. The switching pawls 2 are fixedly fitted to switching shafts 25. The opposite ends of the switching shafts are rotatably supported by bearings, not shown, and arms 30 are fixed to the front ends. Link plates 27 are rotatably engaged to ends of the arms 30 through the pins 29 and the other ends of the link plates 27 are rotatably engaged with plungers of solenoids 26 through the pins 29. Return springs 28 span between the other ends of the arms 30 and solenoid holders 31 to assure that the ends of the switching pawls 2 return to home positions when the solenoids 26 are not energized. When the solenoids 26 are energized, the plungers are attracted to move the arms 30 through the links 27 to allow the switching pawls 2 to incline by a predetermined angle.

Figure 3:
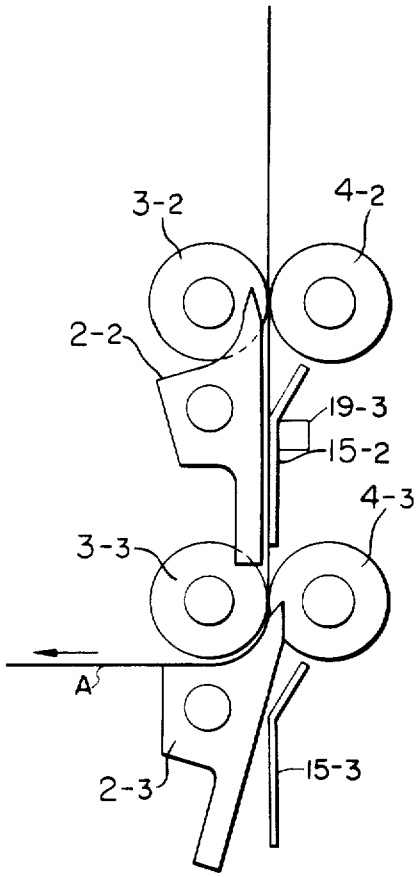
FIG. 3 illustrates a manner of transport of a transfer paper.

FIG. 3 shows a manner of the transport of the transfer paper to a selected bin. For the sake of convenience, only those for the second and third bins are illustrated.

For example, when the transfer paper A is to be transported to the third bin, the transfer paper A moves down the vertical transport section and passes the jam detection sensors 19-1 in a predetermined time and is fed to a space between the vertical feed roller 3-1 and the follower 4-1. The vertical feed roller 3 and the follower 4 forms a roller assembly having rubber rollers arranged on metal shafts with an appropriate gap therebetween, into which the switching pawl 2 extends. When the switching pawl is not actuated, a path for guiding the paper vertically downward is formed by the right side of the switching pawl 2 and the guide plate 15. The transfer paper A is fed past the spaces between the switching pawl 2-1 and the guide plate 15-1, between the vertical feed roller 3-2 and the follower 4-2 and between the switching pawl 2-2 and the guide plate 15-2 so that it passes the jam detection sensors 19-2 and 19-3 in the predetermined time and finally is fed to the space between the feed roller 3-3 and the follower 4-3. The switching pawl 2-3 is rotated to a predetermined angle position by the solenoid 26-3, when the end thereof enters the gap between the feed roller 3-3 and the follower 4-3. Thus, the transfer paper A transported is guided by the switching pawl 2-3 and transported into the third bin by the feed roller 3-3. If the third bin accessed is empty, the transfer paper A is stacked in the bin 1-3 and the light illuminating the empty detection sensor 17-3 from the fluorescent lamp 16 is interrupted so that the sensor 17-3 detects the non-empty state. When the stack of the transfer papers reaches a predetermined height, the stack covers the light receiving surface of the fill detection sensor 18 so that it detects the fill state. Under this condition, the transfer paper is no longer fed to the bin.

Figures 1, 4:
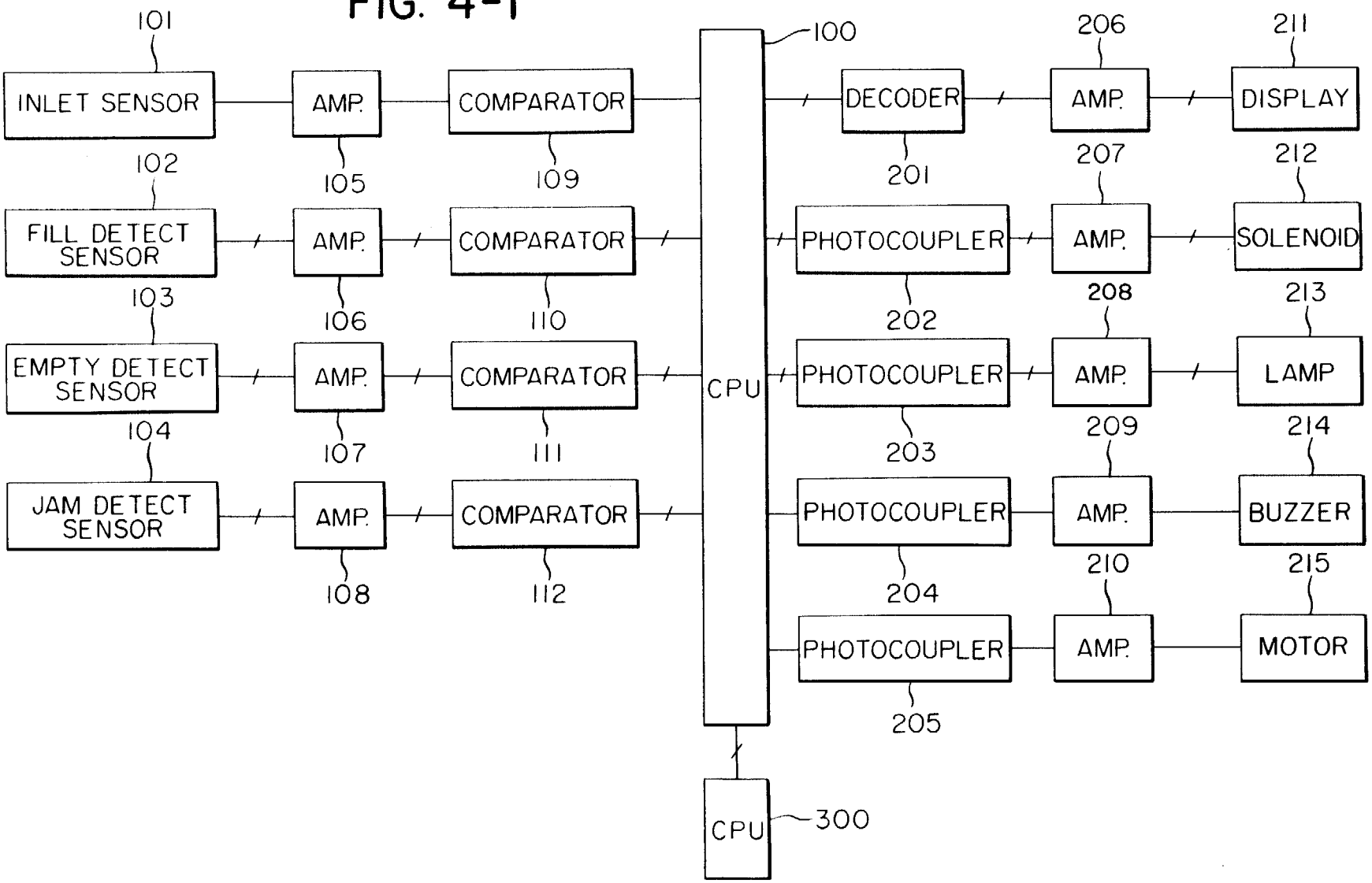
Figures 2, 4:
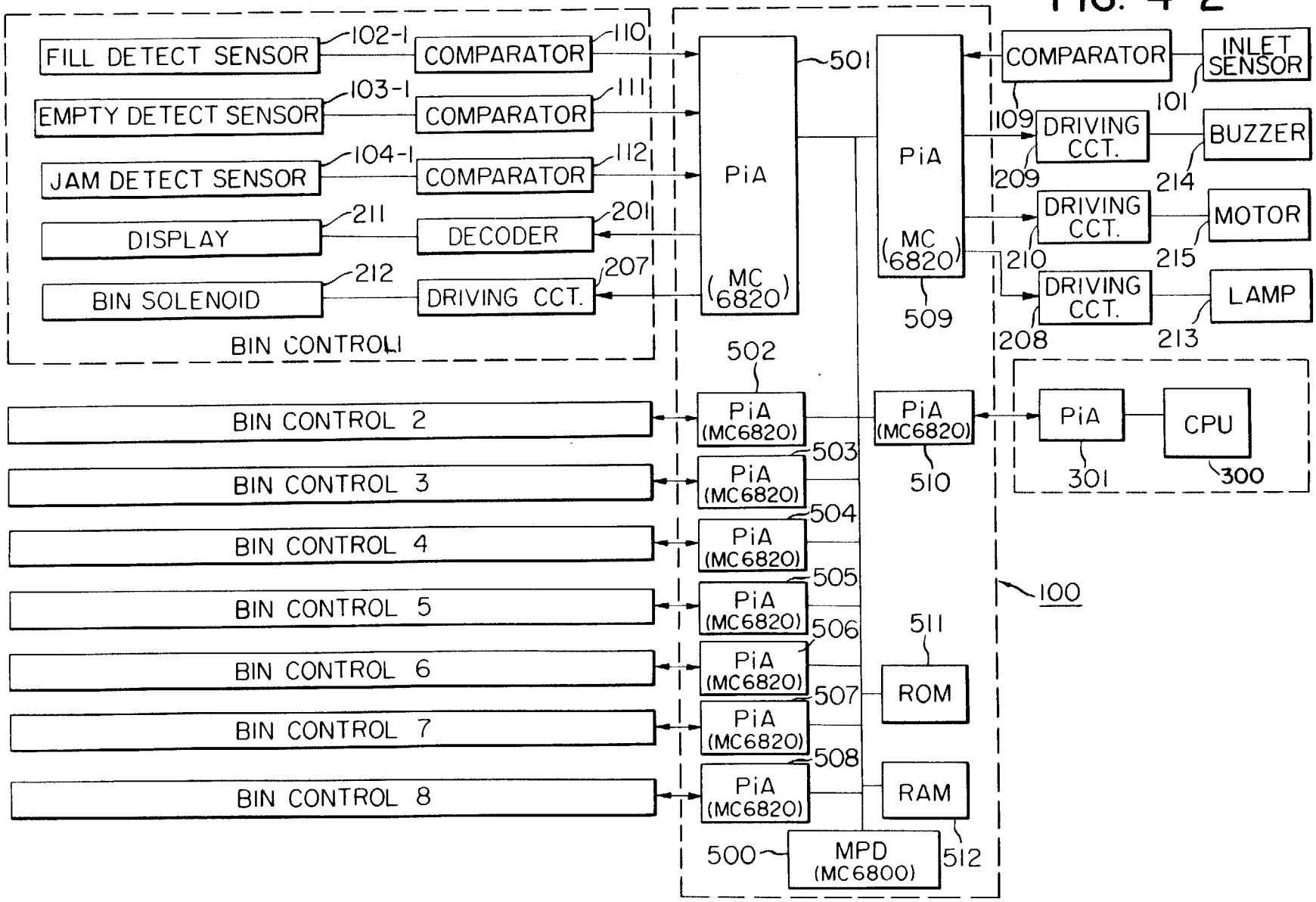

FIG. 4-1 shows a block diagram of a sorter control unit. Numeral 100 denotes a CPU for controlling the operation of the sorter. Signals from the inlet sensor 101, the fill detection sensor 102, the empty detection sensor 103 and the jam detection sensor 104, amplified by amplifiers 105-108, respectively, and binary-converted by comparators 109-112, respectively, by comparison with fixed level voltages, are applied to input terminals of the CPU 100. The binary-coded signal from an output terminal of the CPU 100 is converted by decoders 201, an output of which is amplified by an amplifier 206 to a level to activate an indicator 211 to be described later. The signal from the CPU 100 is also applied to a photo-coupler 202 and an amplifier 207 which activates the bin solenoid 212 to transport the transfer paper to the selected bin. The output from the CPU 100 is also applied to a photo-coupler 203 and an amplifier 208 which activates a lamp 213 to indicate a jam condition. The CPU 100 also interacts with a printer CPU 300 to exchange data necessary for printing and the transport of the transfer paper. The outputs of the CPU 100 are further applied to photo-couplers 204 and 205 and drivers 209 and 210 which activate a buzzer 214 and a motor 215 for driving the sorter, respectively.

Referring to FIG. 1, the inlet sensor 101 corresponds to the sensor comprising the lamp 23 and the photo-sensitive element 24, the fill detection sensor 102 corresponds to the sensors 18-1-8, the empty detection sensor 103 corresponds to the sensors 17-1-8 and the jam detection sensor 104 corresponds to the sensors 19-1-8.

Figures 15, 15A:
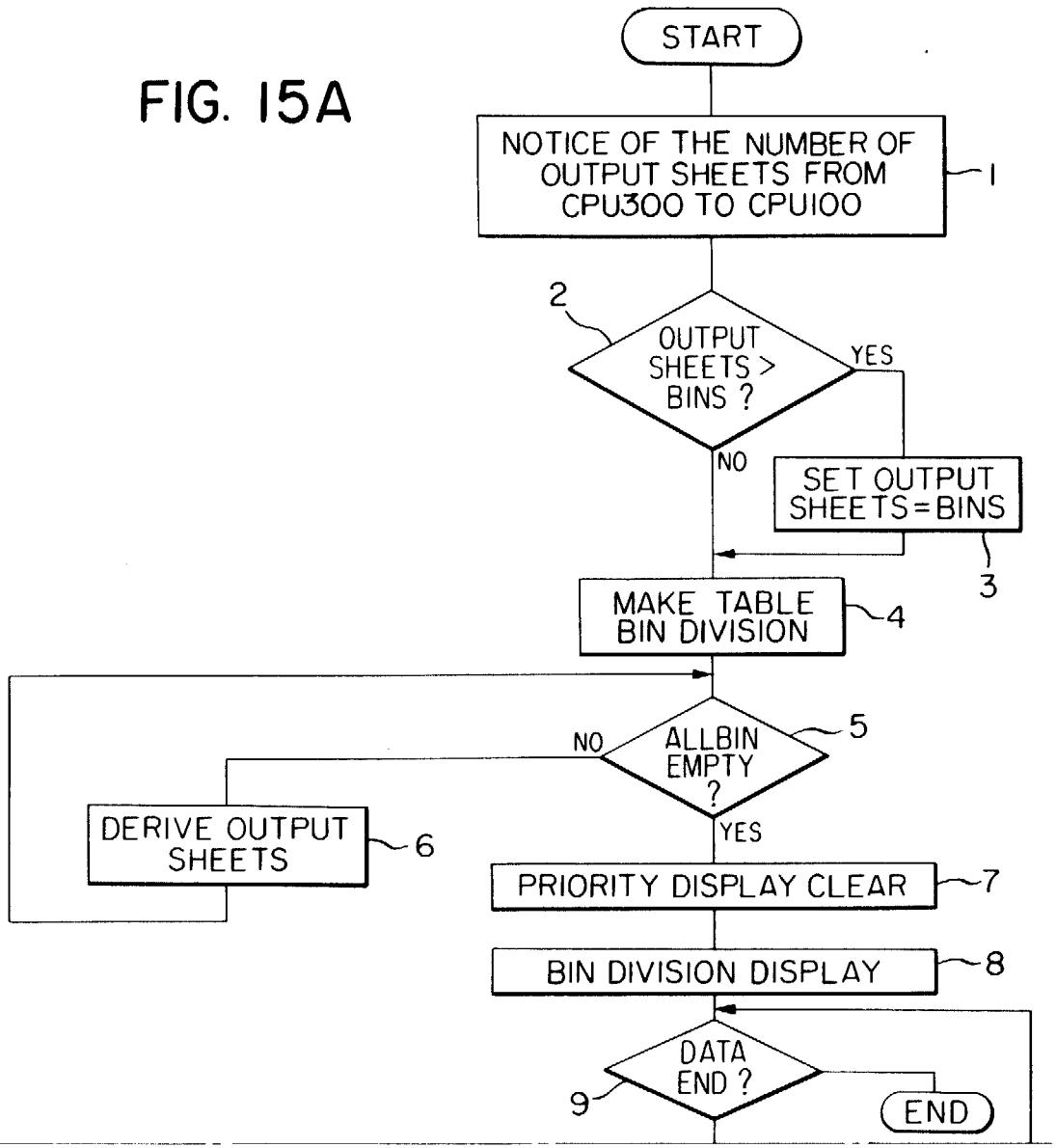
FIGS. 15A and 15B show a flow chart of a control for the sorter operation.
Figure 15B:
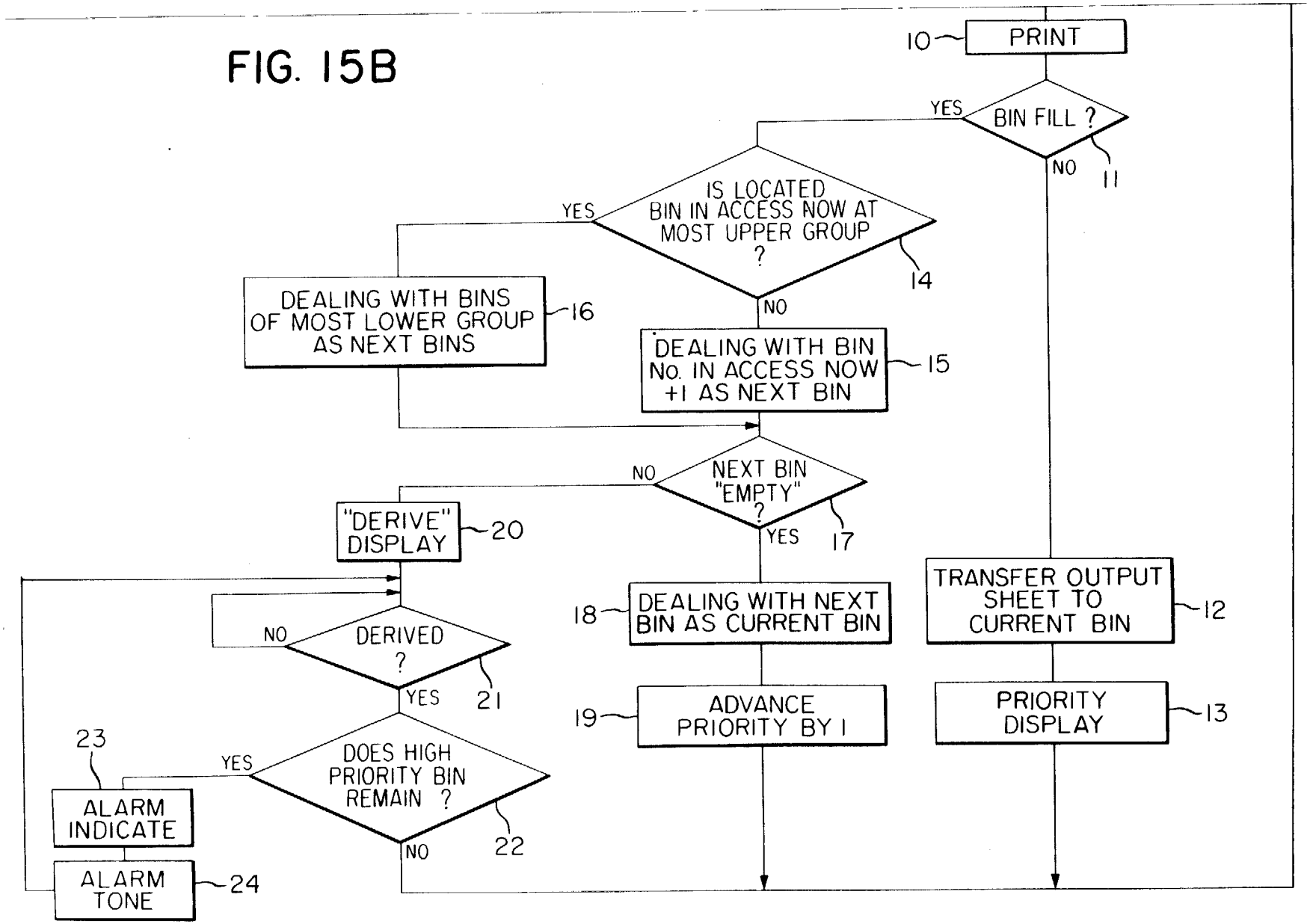

FIG. 4-2 shows a further detail of the control unit. The CPU 100 comprises a micro-processing unit (MPU) 500, peripheral interface adaptors (PIA) 501-510 for interfacing the MPU 500 and I/O devices, a read-only memory (ROM) 511 which stores a control program for the MPU 500 prepared in accordance with a flow as shown in FIGS. 15A and 15B, and a readable and writable random access memory (RAM) 512.

Connected to the PIA 501 is a bin control circuit for the bin 1-1 which comprises a fill detection sensor 102-1, an empty detection sensor 103-1, a jam detection sensor 104-1, an indicator 211-1 and a bin solenoid 212-1. Similarly, bin control circuits 2-8 for the bins 1-2-8, respectively, are connected to the PIA's 502-508, respectively. The inlet sensor 101, the buzzer 214, the motor 215 and the jam indication lamp 213 are connected to the PIA 509. The PIA 510 is connected to the printer CPU 300 through a PIA 301.

The system described above may be constructed by Motorola microcomputer family M 6800 (MPU . . . MC6800, PIA . . . MC6820).

Figure 5:
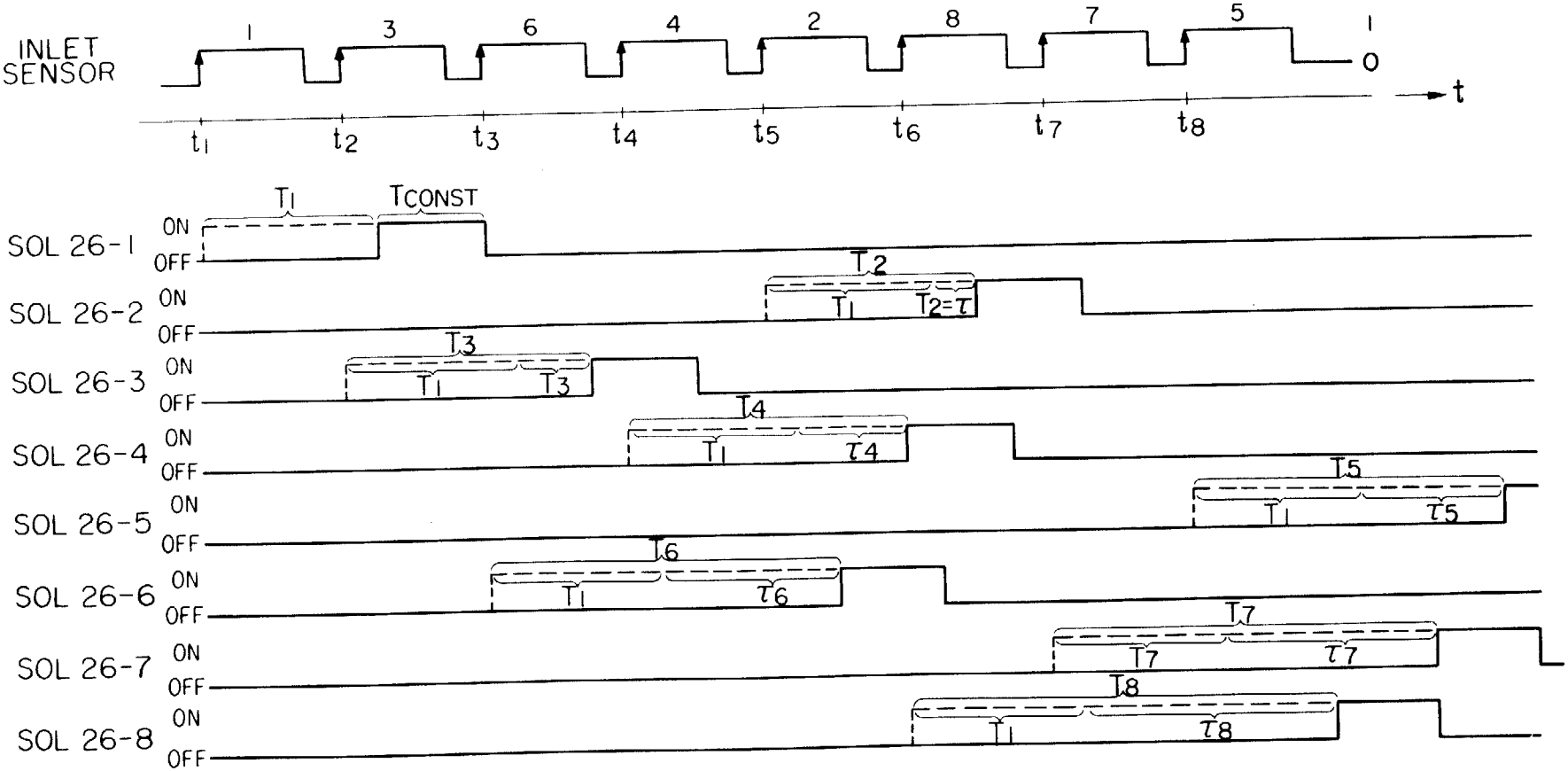
FIG. 5 shows a time chart for explaining the operation of the solenoid when bins are accessed at random.

In the sorter thus constructed, the operation when the destinations of the transfer papers are random, e.g., when they are transported in the order of the first, third, six, fourth, second, eighth, seventh and fifth bins, is now explained with reference to a time chart shown in FIG. 5.

The transfer paper fed into the sorter is sensed by the inlet sensor comprising the lamp 23 and the photo-sensitive element 24 and the sensor output rises. This rise is applied to the CPU 100 through the amplifier 105 and the comparator 109 and the CPU 100 calculates a waiting time Tn required to attract the solenoid of the bin to which the transfer paper is transported. The waiting time T1 to the first bin is readily determined by the transport path length from the inlet sensor to the first bin and the transport rate of the transfer paper. The waiting time Tn to the n-th bin is determined by adding a time Tn required to transport the transfer paper from the first bin to the n-th bin to the above waiting time T1. Assuming that the bins are equally spaced and a time required to transport the transfer paper through the spacing is $\tau$, the waiting time Tn is given by:

$$Tn = T1 + \tau \times (n-1)$$

Based on the waiting time thus determined, the CPU 100 produces a control signal, after the waiting time for the selected bin has elapsed since the transfer paper was detected by the inlet sensor, to activate the solenoid corresponding to the selected bin through the photocoupler 202 and the amplifier 207. Accordingly, if the transfer paper to be transported to the third bin is detected at time t2, the solenoid 26-3 is energized, after the waiting time T3 ($=T1+\tau 2$) as shown in FIG. 5, for a time period T Const required for the transfer paper to be inserted into the bin, and the transfer paper is stacked in the third bin. Similarly, the transfer papers are transported sequentially in the order of the sixth, fourth, second, eighth, seventh and fifth bins.

When two sets of copies are to be stored in the sorter, the bins may be used in two blocks. This will be explained with reference to a time chart shown in FIG. 6. The sorter bins are sectioned into two blocks, one being the eighth to fifth bins and the other being the fourth to first bins, and two copies are produced for each text page with each of the two copies being stored in each block. Assuming that the transfer papers are stored in the bins starting from the bottom bin, the waiting time is calculated in the manner described above and based on the calculated waiting time the solenoids 26-8 and 26-4 are activated or deactivated to store the transfer papers into the eighth bin and the fourth bin alternately. When the eighth bin and the fourth bin becomes full, the bins are exchanged. In the present example, the copies of page 201 and subsequent pages are stored in the seventh and the third bins. Similarly, the transfer papers are stored in the sixth bin and the second bin, and the fifth bin and the first bin in sequence.

Figure 7:
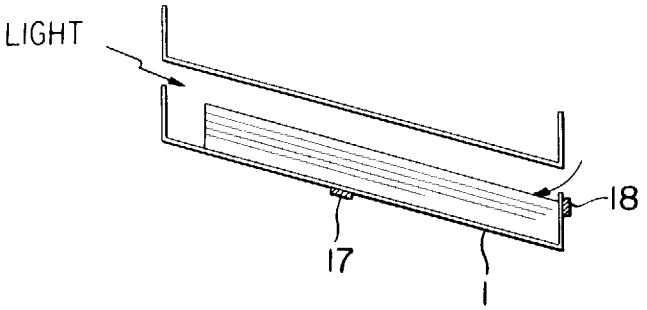
FIG. 7 shows a sectional view of the bin.
Figure 8:
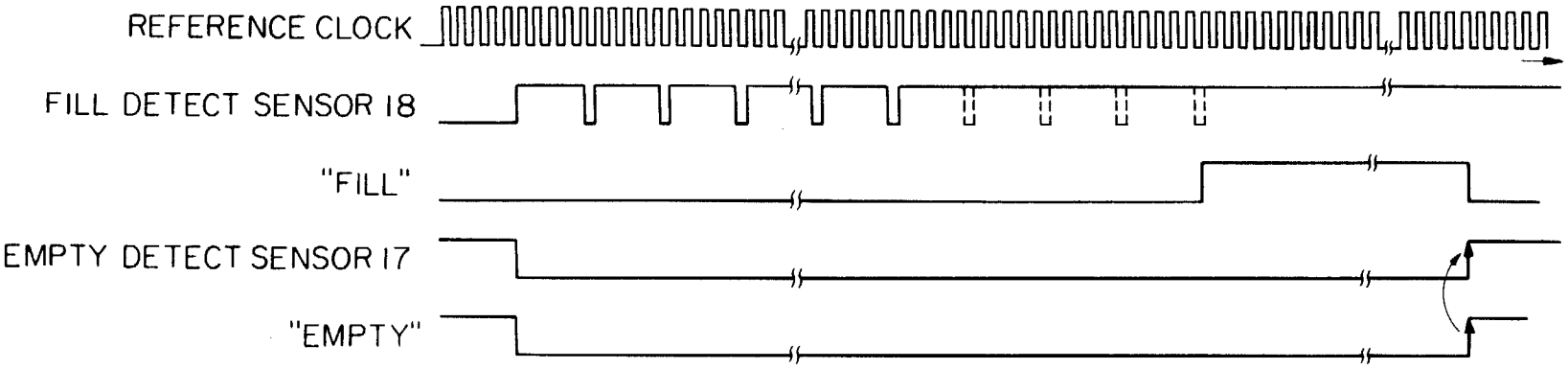
FIG. 8 shows a time chart for explaining the operations of an empty detection sensor and a fill detection sensor.

The bins are provided with the empty detection sensors 17 and the fill detection sensors 18 as shown in FIG. 7. The operation of those sensors is now explained with reference to a time chart shown in FIG. 8. When the bin is empty, the light from the fluorescent lamp 16 (FIG. 1) directly impinges to the sensors 17 and 18 so that the empty detection sensor 17 produces a "1" output and the fill detection sensor 18 produces a "0" output. As the transfer paper is transported to the bin, the empty detection sensor 17 is blocked by the transfer paper and the output thereof changes from "1" to "0" so that the EMPTY signal changes from "1" to "0". As the transfer papers are sequentially transported to the bin, the output of the fill detection sensor 18 alternately produces "0" and "1" repetitively because the light is interrupted by the transfer papers for a constant time interval. When a predetermined amount of transfer papers are stacked in the bin and the surface of the stack completely covers the light receiving surface of the fill detection sensor 18, the output of the sensor 18 continuously assumes "1". When the "1" output of the sensor 18 continues for a predetermined time period, it is determined that the bin is full and a signal FULL changes from "0" to "1". When the transfer papers are subsequently removed from the bins, the output of the empty detection sensor 17 again assumes "1" and the signal EMPTY also assumes "1". At this timing, the signal FULL is changed to "0". Those timings are in synchronism with a reference clock of the CPU 100.

With such a sorter having bins accessible at random, the sorter can be utilized with a maximum efficiency with the number of bins unused being minimum. For example, in a sorter having sixteen bins, when one set of copies are to be produced, all of the first to sixteenth bins may be used unlike the prior art system in which only the first bin is used. The copies are stacked at the sixteenth bin first with the printed face facing to the bin. If the printed face is faced up, the order of the pages is reversed. Assuming that the capacity of the bin is 200 copies, the copies for the pages 1 to 200 are stacked in the sixteenth bin and the fifteenth bin is accessed and the copies for the pages 201 to 400 are stacked therein. In this manner, copies for 3200 pages can be stacked up to the first bin and the sorter can be used as the conventional stacker.

When two sets of copies are to be produced, the sixteen bins are divided into two groups, and one set of copies are stored in the sixteenth to ninth bins while the other set of copies are stored in the eighth to first bins. Two copies are produced for each page and one of the copies is stacked in the sixteenth bin while the other copy is stacked in the eighth bin. After the copies for the page 200 have been produced, the first copy for the page 201 is stored in the fifteenth bin while the second copy for the page 201 is stored in the seventh bin. In a similar manner, the copies are stored up to the ninth and first bins. In this manner, two sets of copies having a volume of 1600 pages can be produced.

When three sets of copies are to be produced, the bins are divided into groups of sixteenth to twelfth bins, eleventh to seventh bins and sixth to second bins, and three copies are produced for each page and the copies are stored in a similar manner to that described above. The first bin is not used in this example.

The manner of division of the bins in accordance with the number of sets when the 16-bin sorter is used is shown in Table 1.

TABLE 1

| No. of Sets | Bin No. 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| 1 | ① | 1 | 1 | 1 | 1 | 1 | 1 | 1 | 1 | 1 | 1 | 1 | 1 | 1 | 1 | $\boxed{1}$ |
| 2 | ① | 1 | 1 | 1 | 1 | 1 | 1 | $\boxed{1}$ | ② | 2 | 2 | 2 | 2 | 2 | 2 | $\boxed{2}$ |
| 3 | ① | 1 | 1 | 1 | $\boxed{1}$ | ② | 2 | 2 | 2 | $\boxed{2}$ | ③ | 3 | 3 | 3 | $\boxed{3}$ | |
| 4 | ① | 1 | 1 | $\boxed{1}$ | ② | 2 | 2 | $\boxed{2}$ | 3 | 3 | 3 | $\boxed{3}$ | ④ | 4 | 4 | $\boxed{4}$ |

TABLE 1-continued

| No. of Sets | Bin No. 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| 5 | ① | 1 | $\boxed{1}$ | ② | 2 | $\boxed{2}$ | 3 | 3 | $\boxed{3}$ | 4 | 4 | $\boxed{4}$ | ⑤ | 5 | $\boxed{5}$ | |
| 6 | ① | $\boxed{1}$ | 2 | $\boxed{2}$ | ③ | $\boxed{3}$ | ④ | 4 | ⑤ | 5 | ⑥ | 6 | | | | |
| 7 | ① | $\boxed{1}$ | 2 | $\boxed{2}$ | ③ | $\boxed{3}$ | ④ | $\boxed{4}$ | ⑤ | $\boxed{5}$ | ⑥ | $\boxed{6}$ | ⑦ | 7 | | |
| 8 | ① | $\boxed{1}$ | 2 | $\boxed{2}$ | ③ | $\boxed{3}$ | ④ | $\boxed{4}$ | ⑤ | $\boxed{5}$ | ⑥ | $\boxed{6}$ | ⑦ | $\boxed{7}$ | ⑧ | $\boxed{8}$ |
| 9 | 1 | 2 | 3 | 4 | 5 | 6 | 7 | 8 | 9 | | | | | | | |
| 10 | 1 | 2 | 3 | 4 | 5 | 6 | 7 | 8 | 9 | A | | | | | | |
| 11 | 1 | 2 | 3 | 4 | 5 | 6 | 7 | 8 | 9 | A | B | | | | | |
| 12 | 1 | 2 | 3 | 4 | 5 | 6 | 7 | 8 | 9 | A | B | C | | | | |
| 13 | 1 | 2 | 3 | 4 | 5 | 6 | 7 | 8 | 9 | A | B | C | D | | | |
| 14 | 1 | 2 | 3 | 4 | 5 | 6 | 7 | 8 | 9 | A | B | C | D | E | | |
| 15 | 1 | 2 | 3 | 4 | 5 | 6 | 7 | 8 | 9 | A | B | C | D | E | F | |
| 16 | 1 | 2 | 3 | 4 | 5 | 6 | 7 | 8 | 9 | A | B | C | D | E | F | G |

Notes:
1 Bins left blank are not subjects of access.
2 Bins marked with ○ are the lowermost bins in the sections.
3 Bins marked with □ are the uppermost bins in the sections.
4 When the number of sets is nine or more, the number of bins allotted is one. Thus, the marks shown in the notes 2 and 3 are not necessary to understand the division.

When the number of copies of each set is A, the number of bins is M, the number of sets is N(M≧N), a storage capacity of each bin is K, the number of bins allotted is L and the number of bins unused is R, then $$M = R + L \cdot N$$

$$A = K \cdot L$$

Thus, the number of copies per set when M=16 and K=200 is given by Table 2.

TABLE 2

| No. of Sets | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| No. of Bins allotted | 16 | 8 | 5 | 4 | 3 | | 2 | | | | | | 1 | | | |
| No. of Bins unused | 0 | 0 | 1 | 0 | 1 | 4 | 2 | 0 | 7 | 6 | 5 | 4 | 3 | 2 | 1 | 0 |
| No. of copies | 3,200 | 1,600 | 1,000 | 800 | 600 | | 400 | | | | | | 200 | | | |

As seen from Table 2, even if the bins of the sorter are divided in accordance with the number of sets as shown in Table 1, if the number of sets is, for example 5, the number of copies per set is as much as 600, which is not sufficient for the high speed terminal such as the laser beam printer. Furthermore, the waiting time is too long when the print operation is resumed after the papers have been removed from the full bins after all of the bins were filled. Accordingly, the apparatus is constructed such that the papers are removed from the full bin so that the emptied bin can be accessed again. If one set of copies is to be produced, the order of the pages will be disordered unless the papers are removed from the sixteenth bin with the faces down and the papers from the fifteenth bin are placed thereon. Similarly, when two sets of copies are to be produced, the papers must be removed from the sixteenth bin and the eighth bin first. The same is true when other numbers of sets of copies are to be produced. Accordingly, it is necessary to set the order of bins from which the papers are to be removed.

Figure 6:
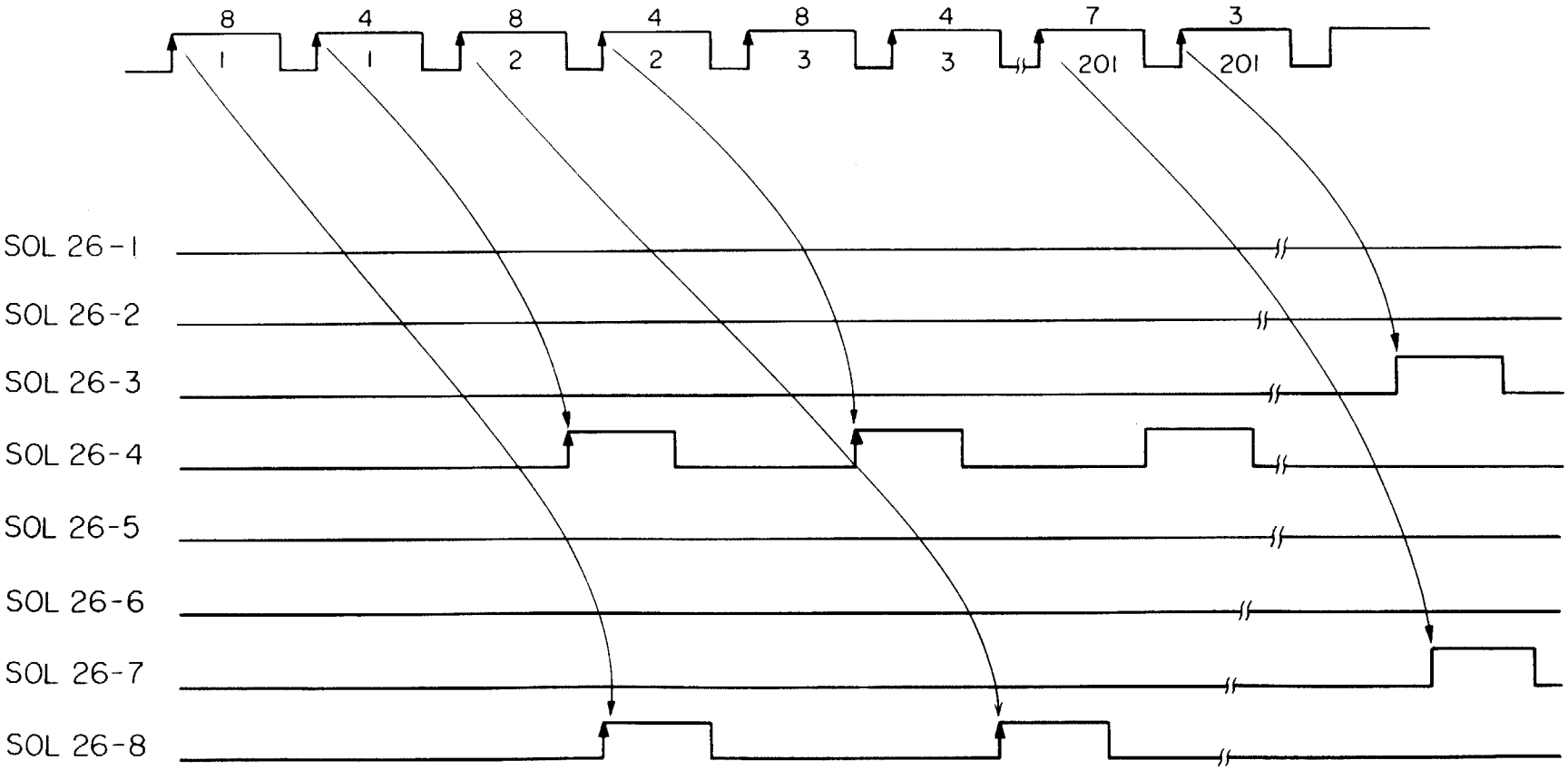
FIG. 6 shows a time chart for explaining the operation of the solenoid when two sets of copies are produced.
Figure 9:
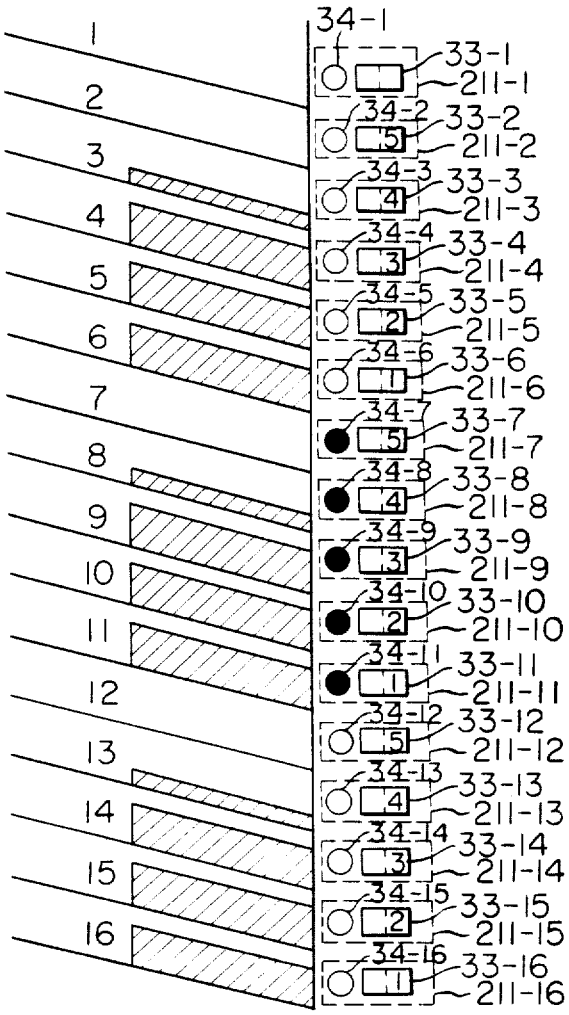
FIGS. 9 to 12 show classification indication of the bins and priority indication of removal.
Figure 10:
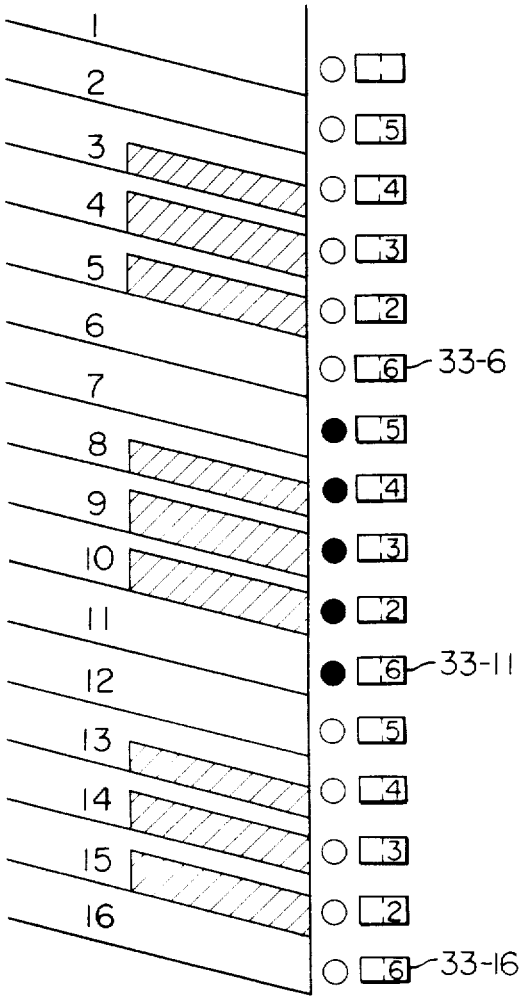
Figure 11:
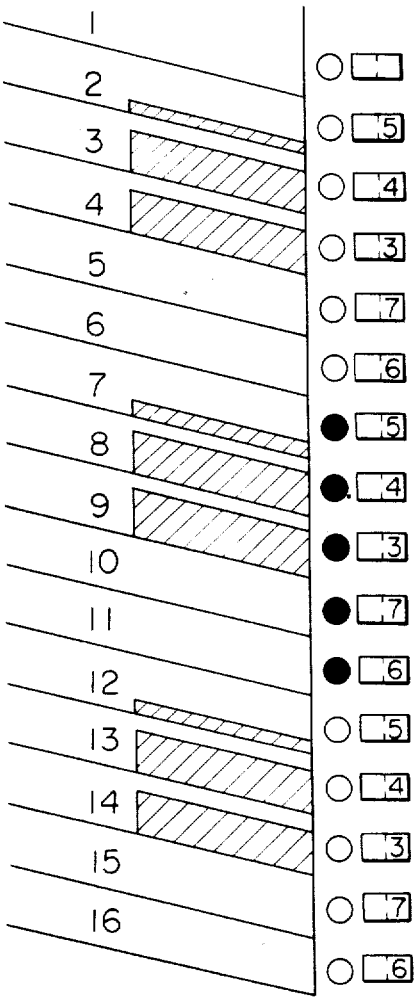
Figure 12:
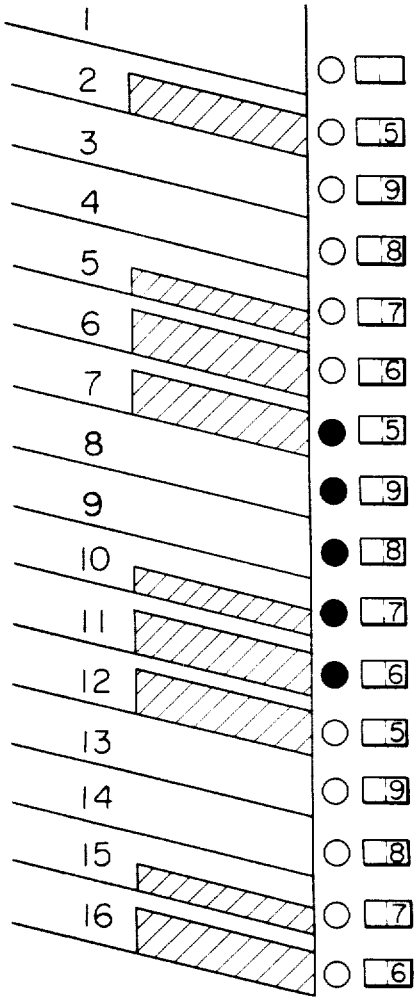

To this end, when the operator removes the paper from the full bins, a priority order is to be given to the bins in accordance with the order of removal and it is to be indicated. In addition, an indicator to indicate a range of bins for one set by flashing or by a numeral is to be provided in order to identify a boundary of the sectioned block for each set and identify the number of bins in each block. FIGS. 9–12 show such arrangements. Numerals 33-1-6 denote two-digit seven-segment indicators for indicating the priority order of the bins, and numberals 34-1-16 denote lamps for indicating the sections of the bins for the selected number of sets. For example, when three sets of copies are to be produced, the bins are sectioned to three blocks, sixteenth to twelfth bins, eleventh to seventh bins and sixth to second bins, as explained above. The lamps 34-7-11 are lit for the eleventh to seventh bins to indicate the boundaries of the blocks sectioned in accordance with the number of sets. The indicators 33-1-16 indicate 1-5, respectively, for the bins of each block with the lowermost bin being indicated as 1 so that the papers are removed from the bins in accordance with the priority order, as shown in FIG. 6. In FIG. 9, three bins in each block are full and they are ready for removal. When the papers are removed from the bins of the priority order 1 as shown in FIG. 10, the indications of the indicators 33-16, -11 and -6 change to 6, which is the lowest priority order. When the papers are removed from the bins of the priority order 2 as shown in FIG. 11, the priority order indications change to 7. When the papers are removed from the bins of the priority orders 3 and 4, the priority order indications are changed to 8 and 9, respectively. Thus, when the uppermost bins in the respective blocks, that is, the twelfth, seventh and second bins are filled, the sixteenth, eleventh and sixth bins are accessed again and the copies are transported thereto. In this manner, the papers in the bins are removed in the priority order so that a large volume of copies can be produced without interruption. If the operator removes the papers from the low priority bins by accident, an alarm is issued by a buzzer or by flashing the indicator.

Figure 13:
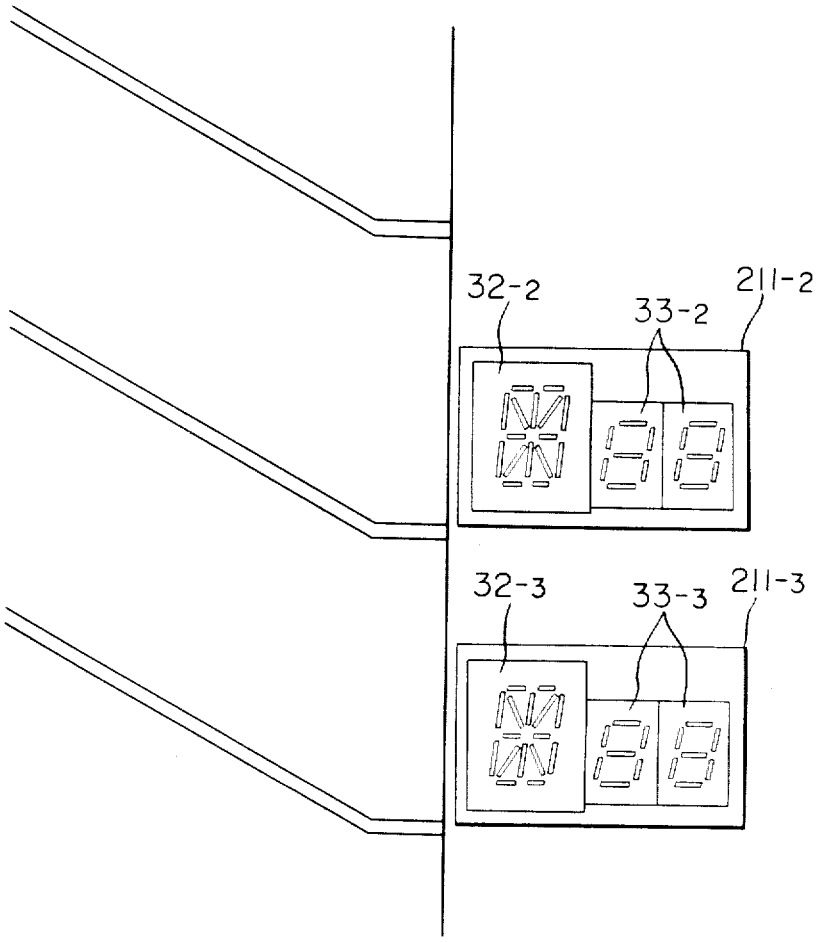
FIG. 13 shows a classification indicator and a priority indicator for removal.
Figure 14:
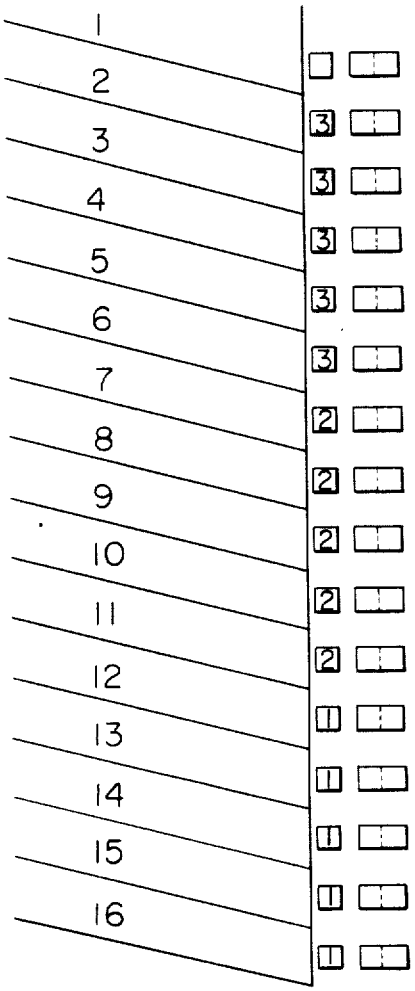
FIG. 14 shows another embodiment of the bin classification indication.

The sections of the bins may be indicated by numerals or characters as shown in FIG. 13, in which numberal 32 denotes 16-segment indicators which indicate numerals between 1-9 and characters between A-G. For example, when three sets of copies are to be produced, the indicators 32-16-12 for the sixteenth to twelfth bins indicate 1, the indicators 32-11-7 for the eleventh to seventh bins indicate 2 and the indicators 32-6-2 for the sixth to second bins indicate 3, as shown in FIG. 14. In this manner, the boundaries of the sectioned bins and the number of sets of copies can be readily identified. By indicating the bin number to which the papers are to be transported, the destination bin can be identified. The lamps can only indicate the boundaries of the sectioned bins, the numerals and the characters can indicate the destination bin.

An overall operation of the collator of the present invention described so far is now explained with reference to a flow chart shown in FIGS. 15A and 15B. In a step 1, the number of sets of prints selected by the operator is informed to the sorter CPU 100 from the printer CPU 300. In a step 2, the number of sets of the prints is compared with the number of bins. If the number of sets of the prints is larger than the number of bins, the number of sets is set to be equal to the number of bins. Thus, when the number of sets which is larger than the number of bins is informed, the number of sets is set to be equal to as much as the number of bins. In a step 4, a bin division table as shown in Table 1 is prepared in accordance with the number of sets. In step 5 and 6, if it is determined that the bins are empty, the indications of the priority orders for the removal in the indicators 33 are cleared in steps 7 and 8, and the bin sections are indicated by the indicators 32 by the numerals 1-9 and the alphabet characters A-G in accordance with the table prepared in the step 4. This may be indicated by flashing the lamp 34.

In steps 9 and 10, the desired number of sets of prints are produced in accordance with input data. In a step, it is determined if the bin being accessed (current bin) is full, and if it is not full, the papers are transported to the current bin. In a step 13, the priority orders for the removal are indicated by the indicators 33 and the process returns to the step 9. When the bin being accessed is filled, it is determined in a step 14 if the current bin is the uppermost bin in the block sectioned in accordance with the desired number of sets in the step 4. If it is not the uppermost bin, the bin which is one higher than the bin number of the current bin is selected as the next bin in a step 15. If it is the uppermost bin, the process proceeds to a step 16 where the lowermost bin in the sectioned block is selected as the next bin. In a step 17, it is determined if the next bin selected in the step 15 or 16 is empty, and if it is empty, the next bin is selected as the current bin is steps 18 and 19, the priority order for removal is advanced by one, and the process returns to the step 9. If it is not empty, the indicator 33 is flashed for the highest priority bin in a step 20 in order to indicate the necessity of the removal to the operator. In steps 21 and 22, it is determined if the papers have been removed from the highest priority bin. If the papers are removed from the lower priority bin, an alarm is issued in steps 23 and 24 by the lamp or the buzzer 214.

As described above, in accordance with the present invention, the random access to the storage bins are possible and the maximum utilization of the storage bins is attained by sectioning the storage bins in accordance with the number of sets desired. In addition, since the full storage bin can be accessed again after the papers have been removed therefrom, the storage bins can be used continously. Furthermore, by indicating the sections of the storage bins and the priority orders for the removal from the full bins, the number of sets can be identified and the misoperation by the operator can be reduced.

What we claim is:

1. A collator comprising:

a plurality of record medium storage bins, transport means for transporting record media to said storage bins, deflection means for guiding said record media to said storage bins, detection means for detecting an empty condition of said record media in said storage bins, and control means for performing storage control for the record media with separation of said plurality of record medium storage bins into groups in accordance with a desired set number, wherein said control means controls the operation of said deflection means such that when a predetermined amount of record media have been stored in a given storage bin in a group during the record medium storage operation, the recording media are transported to another storage bin in the same group, and when said detection means detects that the record media have been removed from the storage bin having the predetermined amount of record media stored therein, the transport of the record media to said emptied storage bin is permitted.

2. A collator according to claim 1 further comprising fill detection means for detecting a full condition of the record medium in said storage bin, said deflection means being switched in response to the detection of the full condition.

3. A collator according to claim 2 wherein said empty condition detection means and said fill detection means include photo-sensitive elements, respectively, and a common light emitting element.

4. A collator according to claim 3 wherein said common light emitting element is a fluorescent lamp.

5. A collator according to claim 1 wherein said collator has M record medium storage bins, and said control means performs storing control for the record media with separation of said M storage bins into L groups to meet a relation of $$M=R+L\cdot N$$

where N is a desired number, R is the number of unused storage bins, and L is determined in accordance with N such that R takes a minimum value.

6. A collator having M record medium storage bins wherein said M storage bins are sectioned into L groups to meet a relation of $$M=R+L\cdot N$$

where

N is the number of sets, R is the number of unused storage bins, and L is determined in accordance with N such that R takes a minimum value, said collator comprising:

transport means for transporting record media to said storage bins, deflection means for guiding said record media transported by said transport means to selected storage bins, fill detection means for detecting a full condition of the record media in said storage bins, and control means responsive to the detection of the full condition of the record media of said fill detection means during the storage operation for the record media to control the operation of said deflection means such that the record media are transported to another storage bin in the group in accordance with a predetermined priority order for storing said record media, said control means permitting the transfer of the record media to the full storage bins after the record media have been removed from said full storage bins in accordance with said priority order.

7. A collator according to claim 6 further comprising detection means for detecting an empty condition of the record media in said storage bins, said control means being responsive to the detection of the empty condition of the storage bin by said detection means to permit the transport of the record media to said empty storage bins.

8. A collator according to claim 6 further comprising indication means for indicating said priority order for removal.

9. A collator according to claim 6 further comprising indication means for indicating the boundaries of the storage bins within said sectioned groups.

10. A collator according to claim 6 further comprising alarm means for providing an alarm when the record media are removed in violation to said priority order.

11. A collator comprising:

a plurality of record medium storage bins, selecting means for selecting a desired one of said plurality of record medium storage bins, said selecting means being capable of selecting a said storage bin at random, transport means for transporting record media to said storage bins, and deflection means for guiding said record media transported by said transport means to selected storage bins, said deflection means being activated after a predetermined transport time interval from a predetermined time point whereby said record media transported by said transport means are stored in desired storage bins selected by said said selecting means.

12. A collator according to claim 11 wherein said setting means sections M storage bins into L groups to meet a relation of $$M = R + L \cdot N$$

where N is the number of sets, R is the number of unused storage bins, and L is determined in accordance with N such that R takes a minimum value.

13. A collator according to claim 11 wherein said predetermined time point is a time when the record medium is detected at an inlet of said collator.

14. A collator comprising:

a plurality of record medium storage bins, transport means for transporting record media to said storage bins, deflection means for guiding said record media transported by said transport means to selected storage bins, control means for performing storing control for the record media with separation of said plurality of record medium storage bins into groups in accordance with a desired set number, and indicating means for indicating the boundaries of the storage bin within said sectioned group.

15. A collator according to claim 14 wherein said indicating means is provided for each of said storage bins.

16. A collator according to claim 14 or 15 wherein said indicating means has a lamp, and indicates the range of said sectioned groups by means of turn-on and turn-off of said lamp.

17. A collator according to claim 14 or 15 wherein said indicating means indicates a different numeral or character for every one of said sectioned groups.

18. A collator comprising:

a plurality of record medium storage bins, transport means for transporting record media to said storage bins, deflection means for guiding said record media transported by said transport means to selected storage bins;

control means for performing storing control for the record media with separation of said plurality of record medium storage bins into groups in accordance with a desired set number, and indicating means for indicating an order for storage bins in each group in accordance with which order the record media are to be stored in the storage bins.

19. A collator according to claim 18 wherein said indicating means indicates said order in a numerical order.

20. A collator according to claim 19 wherein said indicating means reevaluates the content of the indication upon removal of the record medium from the storage bins in accordance with said order.

* * * * *

UNITED STATES PATENT AND TRADEMARK OFFICE

CERTIFICATE OF CORRECTION

PATENT NO. : 4,501,419

DATED : February 26, 1985

INVENTOR(S) : YUJI TAKAHASHI, ET AL.

It is certified that error appears in the above-identified patent and that said Letters Patent is hereby corrected as shown below:

COLUMN 1

Line 16, "stack" should read --stacked paper--.

COLUMN 3

Line 2, after "and" insert --is--.

COLUMN 9

Line 34, after "step" insert --11--.

Line 50, "is" should read --in--.

Signed and Sealed this

*Fourteenth* Day of *January 1986*

[SEAL]

*Attest:*

DONALD J. QUIGG

*Attesting Officer*

*Commissioner of Patents and Trademarks*